US008516759B2

(12) United States Patent
Cottier et al.

(10) Patent No.: US 8,516,759 B2
(45) Date of Patent: Aug. 27, 2013

(54) SYSTEM FOR CONCEALED FASTENING OF BUILDING FINISHING ELEMENTS

(75) Inventors: John Sydney Cottier, Oatley (AU); Kevin O'Leary, Fontana, CA (US)

(73) Assignee: James Hardie Technology Limited, Dublin (IE)

( * ) Notice: Subject to any disclaimer, the term of this patent is extended or adjusted under 35 U.S.C. 154(b) by 0 days.

(21) Appl. No.: 13/025,056

(22) Filed: Feb. 10, 2011

(65) Prior Publication Data

US 2011/0192102 A1 Aug. 11, 2011

Related U.S. Application Data

(60) Provisional application No. 61/303,305, filed on Feb. 10, 2010.

(51) Int. Cl.
*E04B 2/00* (2006.01)

(52) U.S. Cl.
USPC ..... 52/288.1; 52/287.1

(58) Field of Classification Search
USPC ..... 52/287.1, 288.1
See application file for complete search history.

(56) References Cited

U.S. PATENT DOCUMENTS

| | | | | |
|---|---|---|---|---|
| 3,712,003 | A * | 1/1973 | Hallock et al. | 52/254 |
| 3,717,968 | A * | 2/1973 | Olsen et al. | 52/288.1 |
| 4,430,833 | A * | 2/1984 | Balzer et al. | 52/255 |
| 4,706,426 | A * | 11/1987 | Rumsey | 52/232 |
| 5,233,804 | A * | 8/1993 | Miller | 52/288.1 |
| 5,363,617 | A * | 11/1994 | Miller | 52/288.1 |
| 6,219,980 | B1 * | 4/2001 | Peck, Jr. | 52/288.1 |
| 6,354,049 | B1 * | 3/2002 | Bennett | 52/287.1 |
| 7,028,436 | B2 | 4/2006 | Bezubic, Jr. | |
| 8,141,308 | B2 * | 3/2012 | Cashman | 52/287.1 |

* cited by examiner

*Primary Examiner* — Mark Wendell
(74) *Attorney, Agent, or Firm* — Knobbe Martens Olson & Bear, LLP

(57) ABSTRACT

In one form of building structure, trim installations are applied around window or door frame openings and at internal or external corners of a building. The trim serves both an aesthetic purpose in adding a decorative feature to building envelopes and also adds an additional weatherproofing purpose in allowing for more complete weatherproofing of building envelope corners and openings. The present invention relates to a concealed fastening building finishing element system that enables concealed fastening of finishing elements such as trim components, fascia boards, frieze boards, belly band boards, and the like to an underlying structure and to the fixings used in these systems. The invention is particularly useful with trim elements around window and door frame openings and at building corners.

16 Claims, 9 Drawing Sheets

SYSTEM FOR CONCEALED FASTENING OF BUILDING FINISHING ELEMENTS

BACKGROUND OF THE INVENTION

The present invention relates to a concealed fastening building finishing element system that enables concealed fastening of finishing elements such as trim components, fascia boards, frieze boards, belly band boards, and the like to an underlying structure and to the fixings used in these systems.

The invention is particularly useful with trim elements around window and door frame openings and at building corners and will be described hereinafter with reference to these applications. It will be appreciated, however, that the invention is not limited to these particular fields of use and can be used in connection with other building finishing elements where concealed fastening is desired, including but not limited to, band board features, fascia boards, soffits and the like.

Any discussion of the prior art throughout the specification should in no way be considered as an admission that such prior art is widely known or forms part of the common general knowledge in the field.

In one popular form of building structure, trim installations are applied around window or door frame openings and at internal or external corners of a building. The trim serves both an aesthetic purpose in adding a decorative feature to building envelopes and also adds an additional weatherproofing purpose in allowing for more complete weatherproofing of building envelope corners and openings.

Without trim at the external corners of the building, for example, cladding such as planks or panels are each necessarily cut, nailed in place, and sealed against weather effects individually. Traditionally, a favored method was to mitre cut the plank edges to form a joint line which requires a high skill level. However, any building movements tended to cause the mitre joints to open up which as well as being unsightly, exposed the edges and the underlying structure to the weather. Additionally, because primary framing members are traditionally located at the external corners of buildings, it is important for the long term durability of a building that corner treatments are both easy to install and provide improved weather resistance for protection of the structural elements of the building.

Again, without finishing trim at window and door openings, the surrounding cladding panels or planks are necessarily individually cut, fixed in place and weatherproofed to a sophisticated level.

Trim may also allow for simplified installation of cladding such as planks and panels. At corners, for example, the trim is fixed in place first and then the cladding planks are simply square cut and fixed so that the cut edges of the planks butt up against the sides edges of the trim. A sealing compound is also used between the side edges of the trim and the cut edges of the planks to provide additional weatherproofing, without the need to individually treat each plank.

Trim is typically installed by driving fasteners, such as nails or screws through each the surface of trim member and into the underlying structure. The head of the nail or screw is thus visible on the face of the trim. On a pre-finished trim piece, if a smooth surface appearance on the face of the trim is required, the nails must be installed flush with the surface of the trim and the nail heads touched up with paint. If the nails are overdriven below the surface of the trim, the resulting holes must be filled with a water-proof filling compound and/or touched up with paint. It will be appreciated that these additional steps are time consuming and add additional cost to the installation.

U.S. Pat. No. 7,028,436 describes a corner trim piece which includes a cementitious layer moulded on a rigid right-angle backing. The rigid backing reinforces the cementitious layer and overhangs along one longitudinal side of the trim to provide a nailing flange for fixing the sheathing product to an exterior surface of a building. Holes may also be provided through the cementitious layer to allow nailing through the integrated sheathing product. While the reinforcing provided by the backing member provides resistance to cracking of the cementitious layer, it is also likely to increase the overall weight and cost of the trim piece. Additionally, manufacture of the integrated product is likely to be more complex than the manufacture of a simple discrete trim piece suitable for nail or screw fixing, as described above. Furthermore, this sheathing product is likely to have limited installation flexibility, in particular relating to ease of positioning the product in situ due to the nailing flange extending along the entire length of the trim piece. Furthermore, the described trim piece is necessarily provided as a pre-fabricated product and can only be used on corners limiting the flexibility on window and door trim installation.

Similar issues arise with the installation of other standard building finishing elements such as fascia boards, band boards, soffits and the like, in that face fixing through the element complicates the finishing process by requiring touch up painting or the use of prefinished or capped fasteners or the like. This is particularly relevant when prefinished finishing elements are to be used.

BRIEF SUMMARY OF THE INVENTION

In accordance with one aspect of the present invention, there is provided a load-bearing concealed building finishing element fixing tab, the tab including a first portion and a second portion, the first portion being adapted for connection to a structure-facing surface of a building finishing element such that said second portion of said tab extends outwardly from said building finishing element, and said second portion being adapted for connection to a support structure thereby to secure a portion of said building finishing element to said support structure whereby the connection between said first portion of said tab and said structure-facing surface of said building finishing element is substantially concealed from an outwardly directed exterior-facing surface of said building finishing element, the tab being configured, and defined as being load-bearing, in its ability to support said portion of the building finishing element and retain it in a fixed position.

According to another aspect of the invention, there is provided a concealed building finishing element system including a building finishing element having a structure-facing surface and an exterior-facing surface; and at least one load-bearing concealed building finishing element fixing tab, the tab including a first portion and a second portion, the first portion being adapted for connection to a structure-facing surface of a building finishing element such that said second portion of said tab extends outwardly from said building finishing element, and said second portion being adapted for connection to a support structure thereby to secure a portion of said building finishing element to said support structure whereby the connection between said first portion of said tab and said structure-facing surface of said building finishing element is substantially concealed from an outwardly directed exterior-facing surface of said building finishing element, the tab being configured so as to support said portion of the building finishing element and retain it in a fixed position.

According to another aspect of the invention, there is provided a method of securing a building finishing element to a support structure, said method including the steps of selecting one or more load bearing concealed building finishing element fixing tabs, each tab including a first portion and a second portion, connecting said first portion of the tab to a structure-facing surface of the building finishing element such that the second portion extends outwardly from the building finishing element, and connecting the second portion of the tab to a support structure to thereby secure the building finishing element to the support structure whereby the connection between the first portion of the tab and said structure facing surface of the building finishing element is concealed from an outwardly directed exterior facing surface of said building finishing element, the tab or tabs being configured to support the building finishing element and retain it in a fixed position.

According to another aspect of the invention, there is provided a load-bearing concealed corner trim fixing tab, said tab being substantially L-shaped and including a pair of perpendicularly extending arms, each arm including a first portion and a second portion, wherein each said first portion is adapted for connection to one of a pair of perpendicular structure-facing surfaces provided on a corner trim and such that each said second portion extends outwardly from its respective structure facing surface, said second portions each being adapted for connection to a corner structure, thereby to secure a portion of said corner trim to said corner structure such that the connection between each said first portion and said structure-facing surface of the trim is substantially concealed from an outwardly directed exterior-facing surface of said trim, the tab being configured so as to support said trim and retain it in a fixed position. This substantially L-shaped tab can be used for inside or outside corners of a structure.

In a preferred form the trim comprises a pair of trim members which are affixed together in a substantially L shaped configuration by connection of the perpendicular first portions of the tab to each of the structure facing surfaces of the trim elements.

According to another aspect of the invention, there is provided a concealed corner trim system including a pair of trim members, each trim member having a structure-facing surface and an exterior-facing surface; and at least one load-bearing concealed corner trim fixing tab, said tab being substantially L-shaped and including a pair of perpendicularly extending arms, each arm including a first portion and a second portion, wherein each said first portion is adapted for connection to a structure-facing surface of a respective one of a pair of trim members such that said trim members are affixed together in a substantially L-shaped configuration and such that each said second portion extends outwardly from its respective trim member, said second portions each being adapted for connection to a corner structure, thereby to secure a portion of each of said trim members to said corner structure such that the connection between each said first portion and said structure-facing surface of said respective trim member is substantially concealed from an outwardly directed exterior-facing surface of said respective trim member, the tab being configured so as to support said portions of the trim members and retain them in a fixed position.

According to another aspect of the invention, there is provided a method of securing a pair of trim members to a corner structure, said method including the steps of selecting one or more substantially L-shaped load bearing concealed corner trim fixing tabs, each tab including a pair of extending arms, each arm including a first portion and a second portion, connecting said first portions of the tab on each arm to a structure facing surface of a corresponding one of a pair of trim members such that the trim members are affixed together in a substantially L-shaped configuration and such that each second portion extends outwardly from its respective trim member, and connecting said second portions of the tab to a corner structure whereby connection between the first portion of the tab and said structure facing surface of the trim members is substantially concealed from an outwardly facing surface of the trim members, the tab or tabs being configured to support the trim members and retain them in a fixed position.

Preferably, the substantially L-shaped load bearing tabs may be utilized to connect a pair of trim members to either an external corner or an optional internal corner.

The above referenced system and method set out in the above aspects of the invention can be modified for use with a unitary corner trim element as described with reference to the substantially L-shaped fixing tab aspect of the invention. The tab in all aspects may be configured to support and positionally retain the building finishing elements via selection of various features including, for example, material properties, size and shape. Generally, the tabs will require a combination of load bearing strength, bending resistance under cantilevered loads and a resistance to buckling or extension under compressive or tensile loads.

In one embodiment the tab material is selected so as to have sufficient holding strength and rigidity while also being penetrable in situ with a suitable impact fastener such as a nail, staple or screw fastener. In such cases, the tab may be made of any suitable material including metals, plastics, timber or composites such as glass reinforced plastic, etc. Requisite strength and rigidity properties would depend on the properties of the trim component and the number of tabs proposed per trim component.

In accordance with one preferred embodiment of the invention, the first and/or second portions of the tab include one or more pre-formed fastener receiving perforations or areas directed to receive the fasteners, thereby enabling use of a harder, and, possibly structurally more rigid material, which in turn may facilitate use of thinner sectioned tabs which will allow the trim to sit closer for a more flush mounting to the supporting structure.

Alternately, each portion of the load-bearing tabs may include more than one perforation. Additionally, the load-bearing tabs may be multi-perforate. In such embodiments, the first and second portions may each be respectively connected to the corresponding trim member and the underlying structure via one or more of the available perforations. In other embodiments both portions may be solid and without perforations. Yet further embodiments may include a combination of any two or more of solid, single perforation, multiple positioned perforations or general and/or continuous perforations. The first and second portions each include at least one optional perforation for fastening and may be multi-perforate. The number of fasteners used to attach the tab to the trim member and the tab to the underlying building structure will typically depend on the size and weight of the trim member and in some circumstances regard may also be had to the resulting load requirements on the tab.

Advantageously, the perforations in the load-bearing tabs may allow the use of both impact fasteners and screw fasteners with thicker and/or harder high strength material tabs than would otherwise be possible. Again, the required overall strength of the tabs is typically determined by the strength required across one or more tabs to support a trim member having a given length and specific orientation, usually horizontal or vertical. The required strength of the tab may also be determined to some degree by the effect of winds loading on the trim member where this is a relevant consideration.

Additionally, the use of perforations advantageously assists with positioning the tabs relative to the trim members and the underlying structure and/or may provide a guide to appropriate fastener spacing and positioning relative to the tab boundaries. The perforations can be sized and located as necessary depending on the size and weight of the trim member, the number of fasteners required for the forces acting on the load-bearing tab, ease of installation, and for aesthetic reasons.

The perforations are preferably configured to correspond to the received fastener. The perforations may be of any suitable shape and size, including a clearance hole, aperture, cross, circle, square, etc. The perforations may include a screw thread.

Preferably, the fasteners are impact fasteners. The number of fasteners used to attach the tab to the trim member and the tab to the underlying building structure will typically depend on the size and weight of the trim member and the resulting load requirements on the load-bearing tab. In one embodiment staples are used to attach the tab to the trim member, however, alternate fastening means may be used. It is also preferred that nails are used to attach the tab to the structure. However, it will be appreciated that any suitable means of fastening may be used that are in compliance with local building codes. This may include, for example, screws, rivets, bolts, staples, adhesives etc.

In preferred embodiments of the invention the tabs include some form of indicia to provide fastener positioning guides and/or other information that may be useful to the installer. The indicia can be formed in any suitable manner including, for example, by embossing, engraving, etching or printing, and may be in multiple locations on the tabs. In one embodiment of the present invention, a positioning guide is located along a length of the tab. In another embodiment of the present invention, a positioning guide is located along a width of the tab. In another embodiment of the present invention, multiple positioning guides are located on the tab, such multiple positioning guides may be in the same or different directions from one another, depending on the desired positioning for the specific installation. For example, in one embodiment of the present invention, the tab contains a positioning guide running the length of the tab, and a shorter positioning guide perpendicular to the lengthwise positioning guide and running from the lengthwise positioning guide to the edge of the tab.

The invention advantageously allows the use of standard fastening guns and standard commercially available fasteners. This advantageously results in minimum cost of implementation and minimum additional skills required for installers. These advantages are further enhanced when the tabs include indicia in the form of fastening guides.

Preferably, the load-bearing tabs are discrete tabs. Advantageously, tabs are able to be connected to any position on the structure facing surface of the trim member. This provides flexibility of positioning the tabs to suit various installation requirements and work around various obstructions, etc. The width of each tab is preferably smaller than the edge dimensions of the building finishing element to which it is connected. In this regard, the width is preferably selected such that when a tab is secured to the end of a first building finishing element which is to abut with an adjacent second building finishing element, such as happens with trim at the corners of openings and the like, there is room for the second trim member to sit over the second portion of the tab securing the adjacent end of the first trim member, without the first portion of the tab on the second trim member overlapping with the second portion of the first trim member.

Preferably, the first portion and second portion of the tab are substantially collinear with respect to each other. The second portion preferably extends outwardly from the building finishing element in a direction parallel to the structure-facing surface.

When installed, the load-bearing tabs are required to resist compression loads, tension loads and cantilevered bending loads. In a preferred form, the load-bearing tabs are formed from steel or aluminum strips, however, it will be appreciated that a wide variety of materials and configurations could be used to achieve the desired result of supporting the building finishing element and fixing them to the underlying building structure.

In preferred forms, the building finishing elements are trim members which are preferably formed of fibre reinforced cement but can be made of other materials including but not limited to wood, vinyl, plastics, and the like and composites thereof.

Preferably the support structure and corner structure are formed using a weatherproof material. This material may be in the form of sheets or weather barriers. In one preferred form, the support structure and corner structure are formed from an OSB substrate. Alternatively, the support structure and corner structure may be formed from plywood sheets.

Preferably, each building finishing element is secured to the support structure by a plurality of the load-bearing tabs. It will be appreciated that the number, size and configuration of the tabs will depend upon the size and weight of the trim member. Other factors may, in some situations, include external forces acting on the building finishing element when installed, for example, wind loading.

Preferably, the structure facing surface of each building finishing element is substantially planar. In some embodiments, the rear-surface of each building finishing element includes a recess for locating the load-bearing tab such that, when connected to the trim member, the first portion of the tab lies generally flush with the structure-facing surface of the trim member. The structure facing surface of the trim member may also have one or more grooves along its length and/or width.

In some preferred applications, cladding is installed adjacent the edge of each installed trim member. Further preferably, the installed cladding covers the exposed second portion of each load bearing tab. A sealing compound is preferably applied between the edges of the trim and the adjacent ends of the cladding pieces.

While the preferred forms of the tabs, system and construction method relate to the installation of building finishing elements in the form of trim, other embodiments can be configured for use with other building finishing elements such as fascia boards, band boards, soffits and any other finishing elements where concealed fixing is desired using the basic principles described herein.

BRIEF DESCRIPTION OF THE DRAWINGS

Preferred embodiments of the invention will now be described, by way of example only, with reference to the accompanying drawings in which.

DETAILED DESCRIPTION OF THE INVENTION

Figure 1:
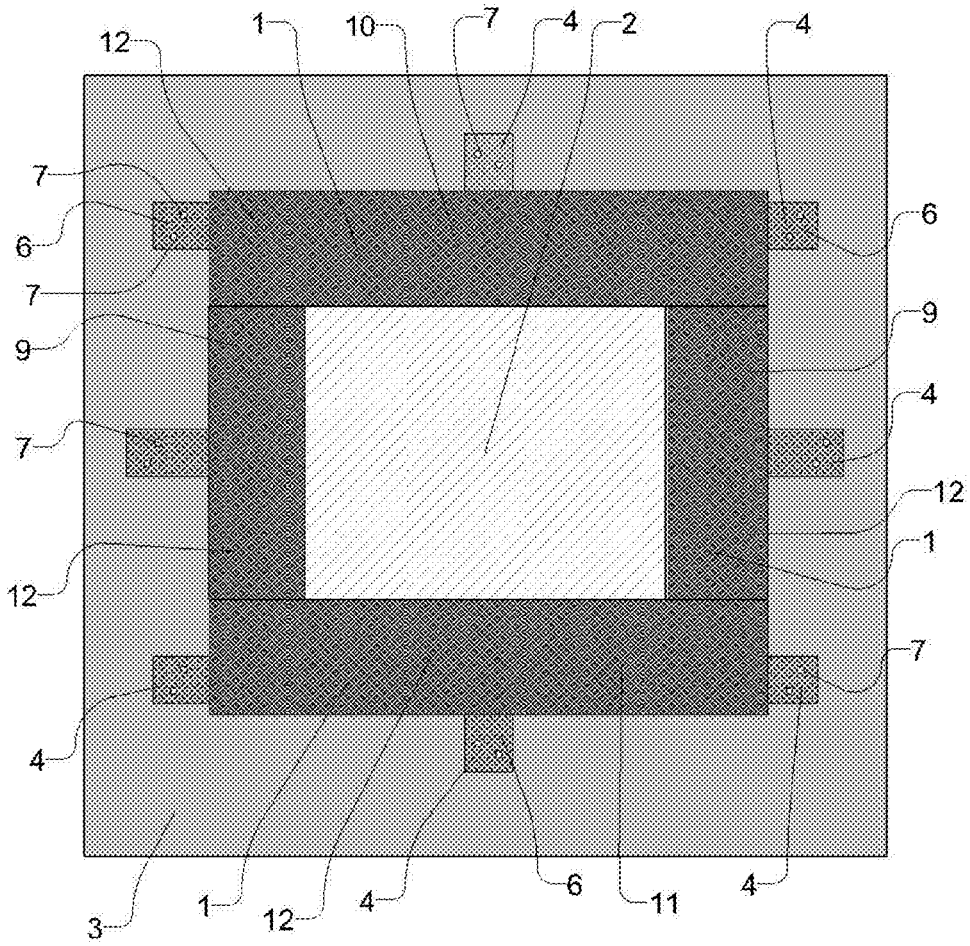
FIG. 1 is a front view of a window trim installation of trim members incorporating fixing tabs in accordance with one embodiment of the present invention.

In the description which follows like parts are marked throughout the specification and drawings with the same reference numerals, respectively. The drawings figures may not necessary be to scale and certain elements may be shown in generalized or somewhat schematic form in the interest of clarity and conciseness.

Figure 2:
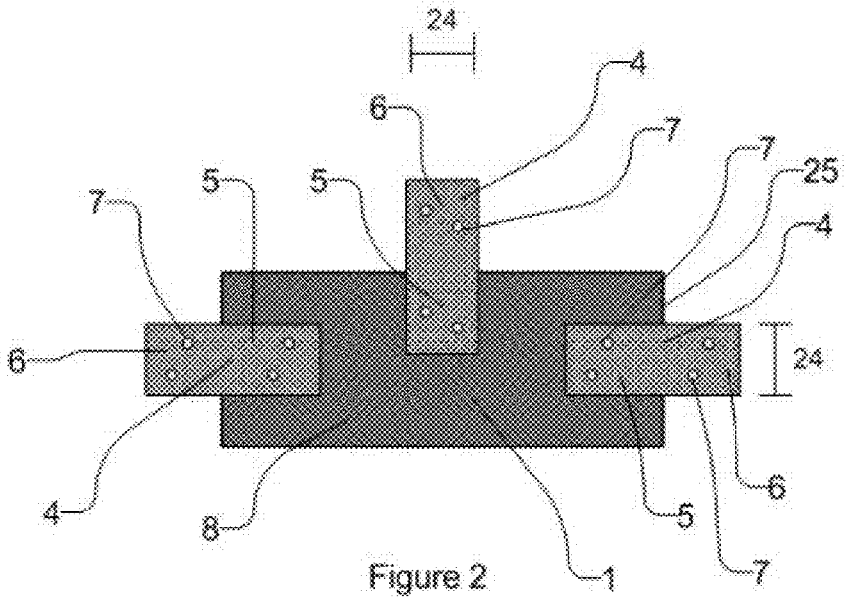
FIG. 2 is a rear view of one of the trim members from FIG. 1, showing a use of load bearing tabs connected thereto.

Referring to FIGS. 1 and 2 of the drawings, a system according to one embodiment of the invention is illustrated in the form of window trim installation which includes a plurality of building finishing elements in the form of trim members 1, each affixed around a window 2 to the underlying exterior structure of the building 3 by three rigid load bearing tabs 4.

Each load bearing tab 4 includes a first portion 5 and a second portion 6, each portion, optionally, having a number of perforations 7. The tab 4 may be, for example, nailed, stapled, or screwed to a structure-facing surface 8 of each trim member 1 through one or more of the optional perforations 7 in the first portion 5 of the tab 4, such that the second portion 6 extends outwardly from the trim member, as best shown in FIG. 2. The second portion 6 of each tab 4 preferably extends directly outwardly in a direction parallel to the structure-facing surface 8 to advantageously provide parallel installation of the trim members relative to the underlying structure 3. The tab 4 may be attached to the trim members 1 either on the building site during installation or pre-fitted elsewhere and delivered to the site. Tab 4 may be secured to the trim member 1 by laying the trim members 1 in the configuration in which they are to be applied to the structure 3 and utilizing tabs 4 of suitable width. In one embodiment, the width of tab 4 is selected such that when a tab 4 is secured to the end of a first trim member 1 which is to abut with an adjacent second trim member 1, such as happens with the trim members at the corners of the illustrated window opening, there is room for the second trim member to sit over the second portion of the tab securing the adjacent end of the first trim member, without the first portion of the tab 5 on the second trim member overlapping with the second portion of the first trim member. This is best illustrated with reference to FIG. 7 which shows the first portions 5 of the tabs on the bottom trim member 11 as providing clearance with the second portions of the lowermost tabs on each of the side trim members. For trim member 1 having a width of 4", the length and width dimensions of tab 4 is preferably about 3.5"×2", respectively, and the overall thickness of tab 4 is generally 18 gauge. It is understood that tabs 4 may vary in length and width, depending, for example, on the size of the trim member. It is also understood that the thickness of tabs 4 may vary. In one embodiment of the invention tab 4 has a thickness in the range of from about 16 to 20 gauge. It will be further understood that the tabs 4 may be of varying shapes and sizes (and thicknesses) depending on various factors, for example, the type, size, and weight of the trim member utilized.

In some embodiments, the structure-facing surface 8 of each trim member 1 includes a recess (not shown) in which the load-bearing tab may be placed such that, when connected to the trim member, the first portion of the tab lies generally flush with the structure-facing surface of the trim member.

Figure 3:
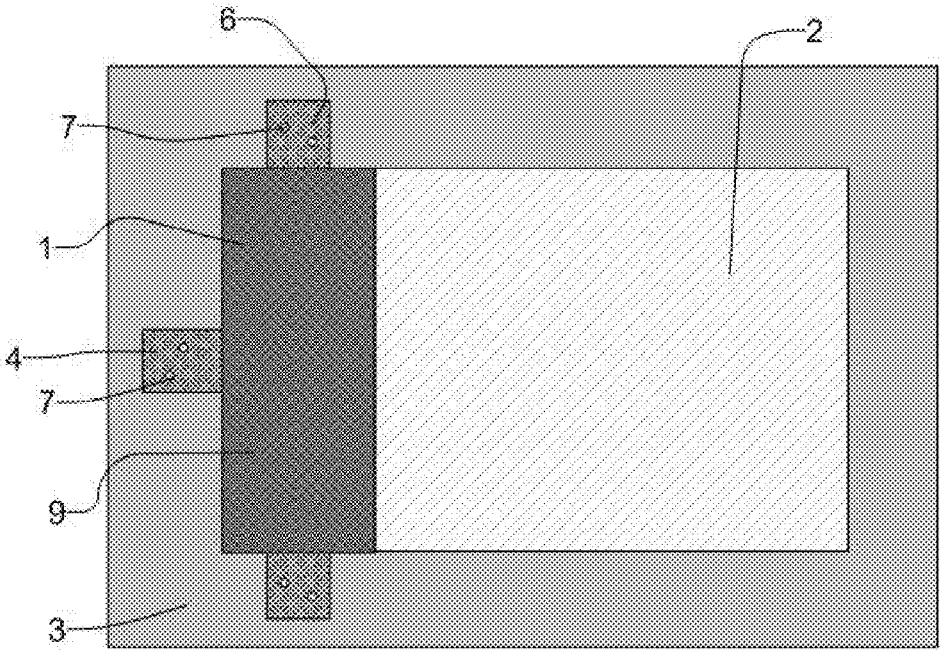
FIG. 3 is a front view of the window from FIG. 1, showing one side trim member installed.
Figure 4:
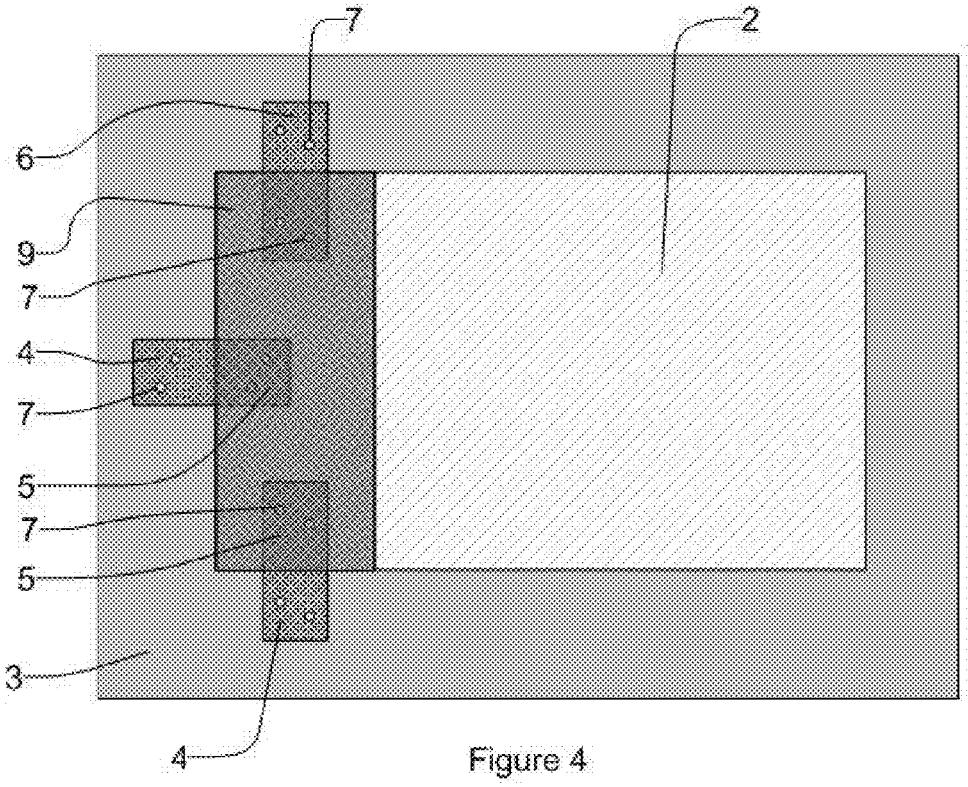
FIG. 4 is a view similar to FIG. 3, showing the side trim member as transparent to show the connection between the tabs and the structure facing side of the side trim member.
Figure 5:
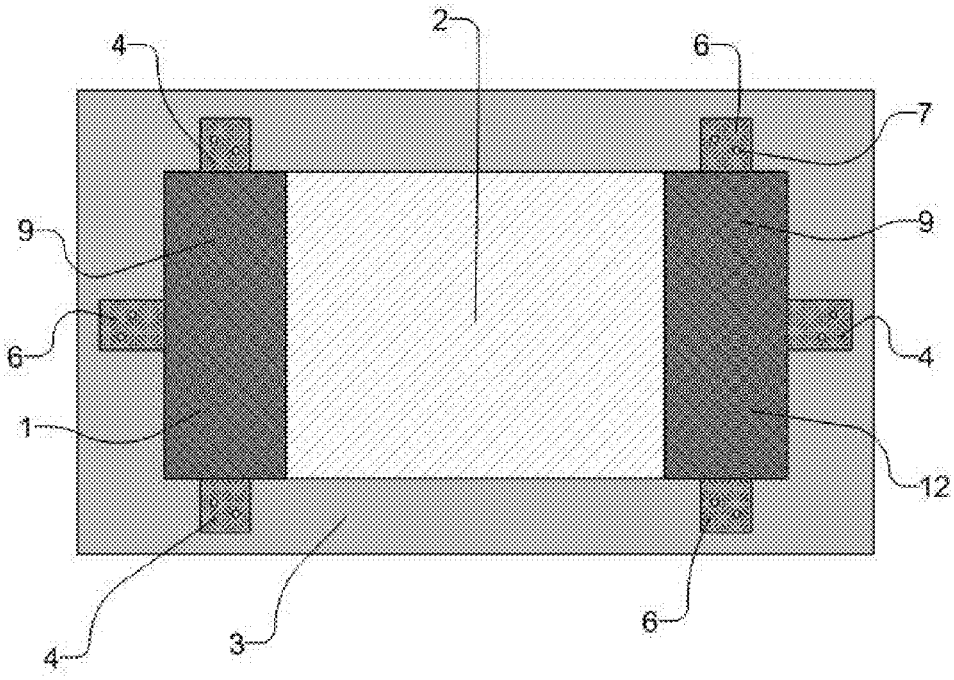
FIG. 5 is another front view of the window of FIG. 1, showing the other side trim member installed.
Figure 6:
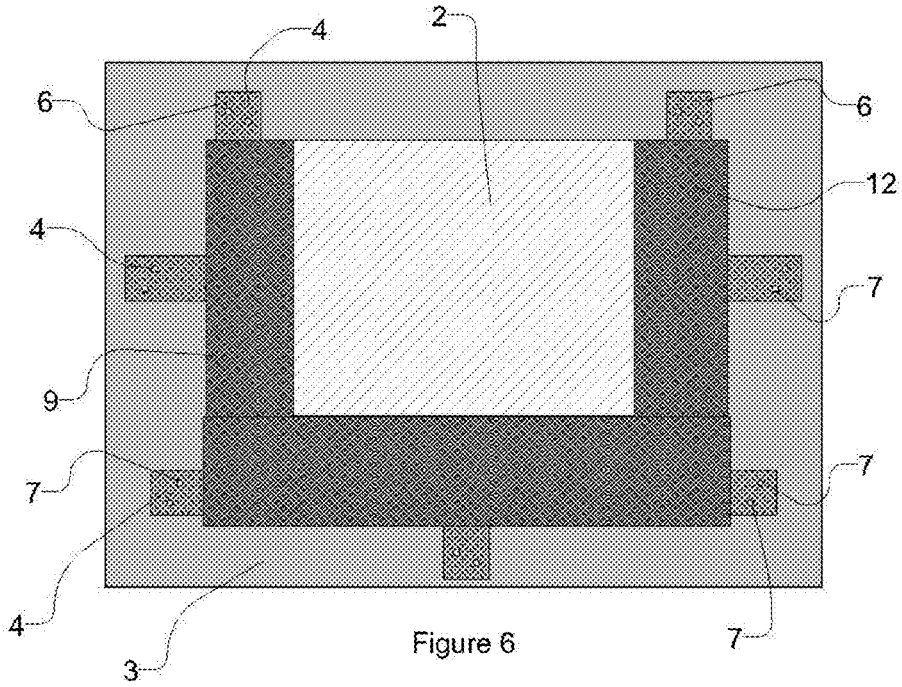
FIG. 6 is a front view of the window of FIG. 1, showing the bottom trim member installed.

Turning to FIGS. 3 and 4, there is illustrated an installation of building finishing elements around a window in accordance with one embodiment of the invention. As shown in FIGS. 3 and 4, a building finishing element 1 is placed in the desired position at one side of the window and the protruding second portion 6 of each tab 4 is secured (e.g., by nailing) to the underlying exterior structure 3 of the building. This secures the building finishing element to the underlying support structure 3. Referring to FIGS. 5 to 7 and FIG. 1, additional trim members are installed by the same method to completely surround the window opening 2. In the embodiment shown, the side trim members 9 which are to be fixed within the ends of the top and bottom trim members are installed first, followed by the top 10 and bottom 11 trim members. It will be appreciated that the order required will vary according to the particular configuration of the trim members in the installation.

As best shown in FIGS. 1, 3, 5 and 6, the connection between the first portion 5 of each tab 4 and the structure facing surface 8 of the trim member 1 is not visible from an outwardly-directed exterior facing surface 12 of the trim member.

The tabs 4 and trim members 1 may also be used to provide a door trim installation (not shown), in which case there is typically no bottom trim member 11 present. The location of the tabs with respect to each trim member may necessarily be altered to suit such an installation. For example, in a door trim installation, the side trim members 9 may each have one tab connected to the upper end of the trim member and one or more tabs connected along the length of the trim member so that the trim member can be installed with the lower end substantially flush to the ground, if desired.

Figure 8:
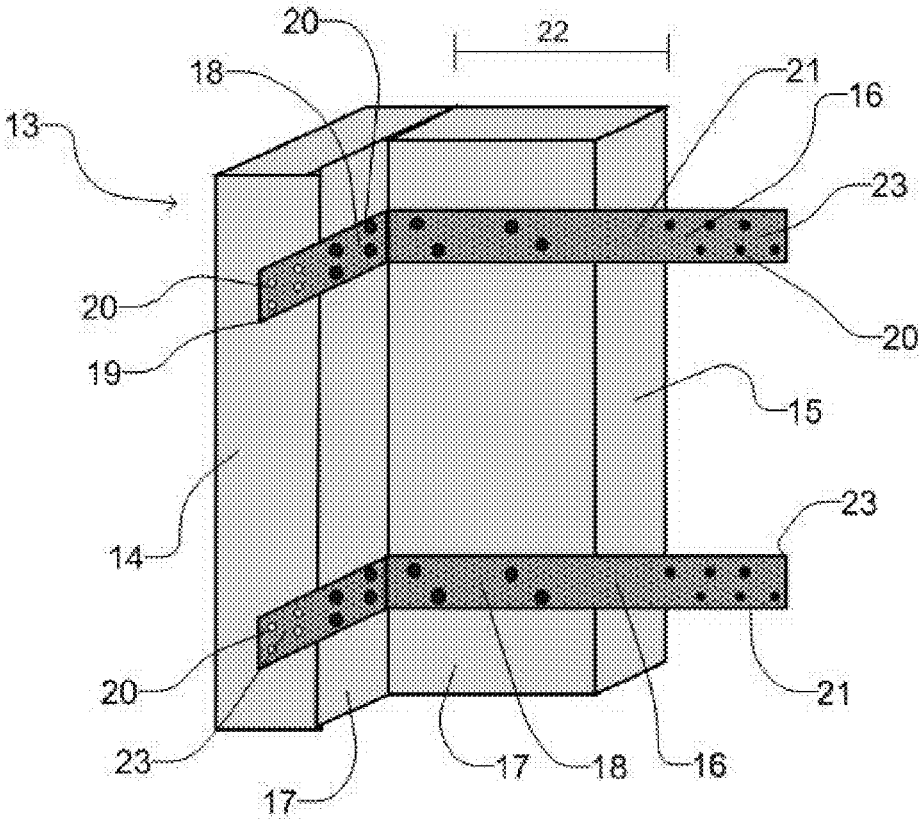
FIG. 8 is a perspective view of a corner trim member.
Figure 9:
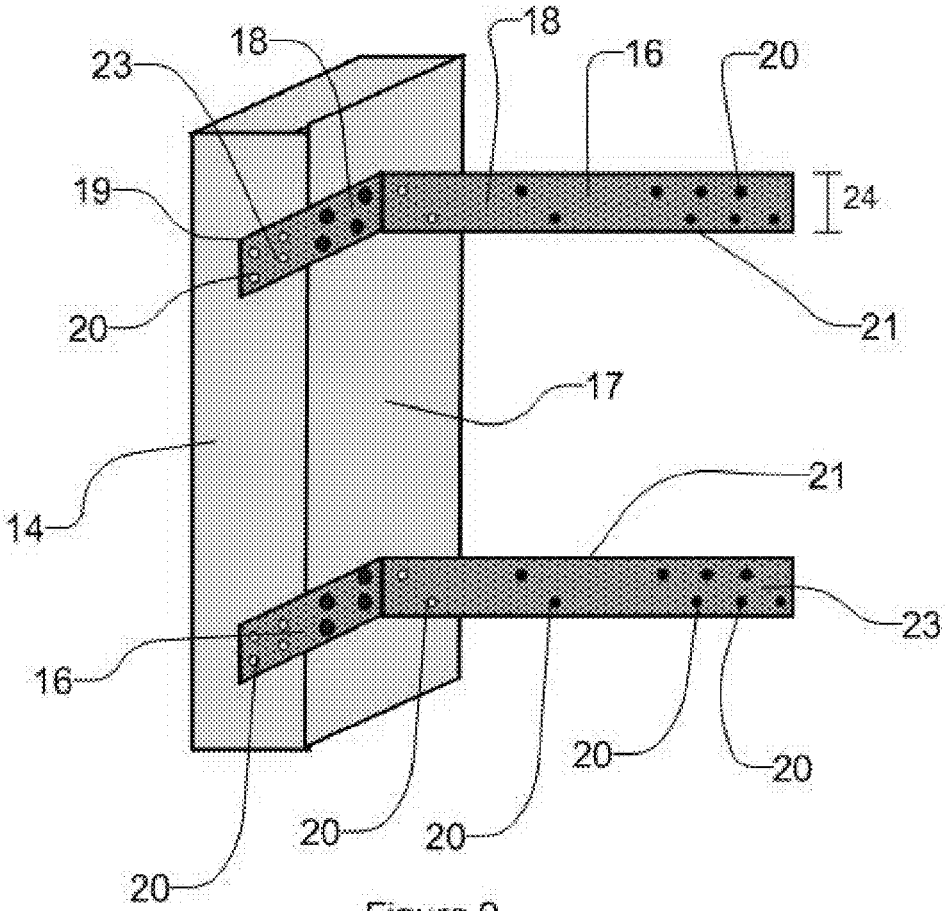
FIG. 9 is a perspective view showing one trim member connected to an L-shaped tab.
Figure 10:
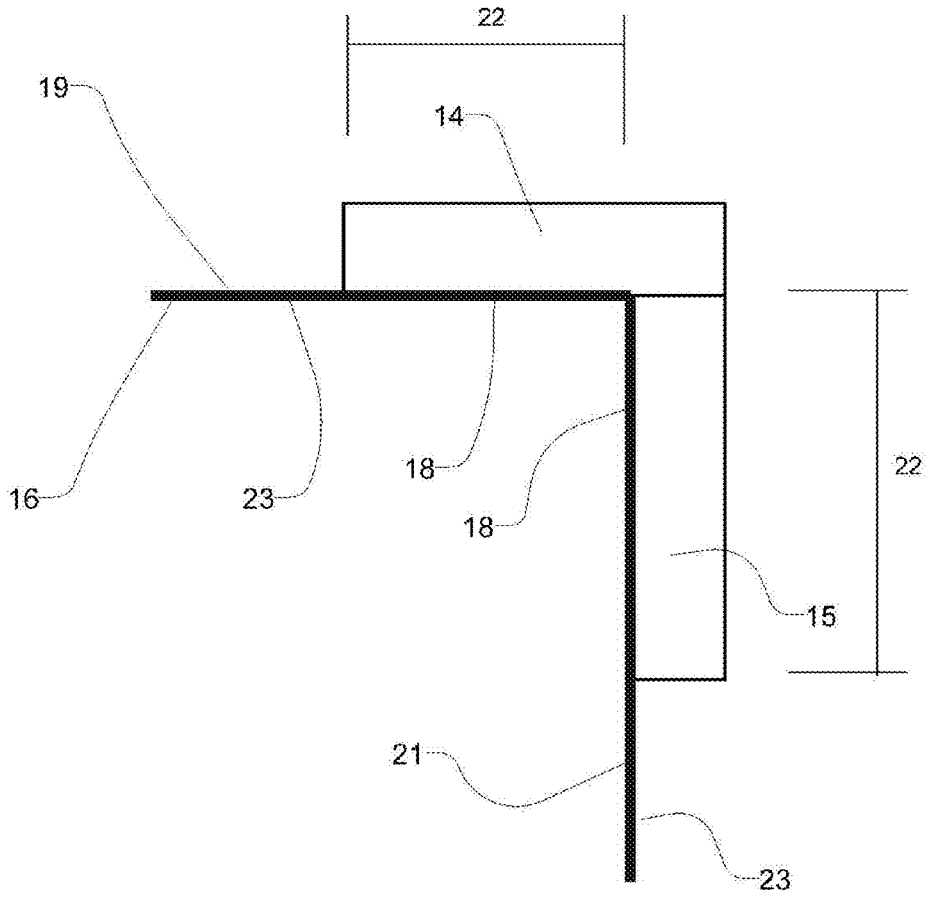
FIG. 10 is a top view showing the L-shaped configuration of the connected trim members.

Referring now to FIGS. 8-10, a corner trim arrangement 13 is shown having a pair of trim members 14, 15 connected to a substantially L-shaped tab 16. The structure facing surface 17 of one of the trim members 14 is connected to a first portion 18 of a respective arm 19 of the tab via one or more of the optional perforations 20 in the respective first portion 18, as shown in FIGS. 8 and 9. The other trim member 15 is positioned at right angles to the first trim member 14 and its structure facing surface 17 is connected to the first portion 18 of the other arm 21 of the load bearing tab 16, such that the trim members 14, 15 form an L-shape when viewed in cross-section. In the embodiment shown, two L-shaped tabs 16 are used to connect the trim members 14, 15 together. However, it will be appreciated that any number of tabs 16 may be used, depending upon the size and weight of the trim members and, in some circumstances, the forces acting upon them when installed may also need to be taken into consideration. The trim members are back fixed together with the external faces (not shown) of the trim members being free from any fixing marks.

Optionally, the first portion 18 of each arm 19, 21 includes at least one perforation 20 to facilitate fastening of the tab 16 to each trim member 14, 15. In the embodiment shown, each first portion 18 includes four perforations 20 however it will be appreciated that the first portions may each include any number of perforations. The two first portions of the L-shaped tab 16 may each include a different number of perforations, if desired. In some embodiments, each first portion 18 will be multi-perforate to allow for multiple connections points as well as providing a number of options in respect of the location of each of the connection points relative to the L-shaped tab. In other preferred embodiments no perforations will be required and the fasteners can automatically pierce through the tab portions during the fastening process.

It will be appreciated that the trim members 14, 15 may each be installed on the other side of the L-shaped tab 16 to form an internal corner (not shown).

Each arm 19, 21 of the load bearing tab 16 is longer than the width 22 of the connected trim member 14, 15, forming a second portion 23 which extends outwardly from the respective trim member.

The corner trim arrangement 13 is positioned with the L-shaped tabs 16 placed adjacent a corner structure (not shown), such as a wall or a frame, and the overhanging second portions 23 of the tabs 16 are connected to the underlying structure via the optional perforation or perforations 20 in each second portion 23. It will be understood that the corner structure may be either an external corner as for the corner trim arrangement 13 shown in FIG. 8, or an internal corner for a corner trim arrangement (not shown) where the structure facing surfaces of the trim members 14, 15 are each connected to the other side (not shown) of the L-shaped load-bearing tab 16.

While the corner trim illustrated is comprised of two planar trim members, it will be appreciated that the L shaped tab can readily be used with preformed three dimensional corner members such as those that may be pre-connected to each other prior to installation, or unitary corner pieces such as those that may be formed by a casting, folding or extrusion process.

Following installation of the trim members 1, 14, 15 around a window 2 or door opening or to a corner structure, cladding (not shown) is installed adjacent the edge of each trim member 1, 14, 15. The installed cladding ideally abuts the edge of the adjacent trim member and covers the exposed second portion 6, 23 of each load bearing tab. A weatherproof sealing compound (not shown) can also be applied to any gaps between the cladding and the trim members to provide additional protection against weather effects.

As shown in FIG. 10, for trim members 14, 15 having a width of 4", the length and width dimensions of tab 16 is preferably about 5.5" long for the first arm 19, 5.5" long for the second arm 19 and 1.5" in width for both first and second arms, and the overall thickness of tab 16 is generally 18 gauge. It is understood that tab 16 may vary in length and width, depending, for example, on the size of the trim members 14, 15. In another embodiment, the length of the first arm 19 of the substantially L-shaped tab 16 is approximately 5.9" and the length of the second arm 21 of the substantially L-shaped tab 16 is approximately 6.7". It is also understood that the thickness of tab 16 may vary. It will be further understood that the tab 16 may be of varying shapes and sizes (and thicknesses) depending on various factors, for example, the type, size, and weight of the trim member utilized.

In one embodiment, the length of the planar tab 4 is approximately 3.0 inches. In another embodiment the width of the tab 4, 16 is about 2" and the preferred thickness of the tabs is about 0.63". In a further embodiment of the invention tab 4 has a thickness in the range of from about 16 to 20 gauge.

The optional perforations 7, 20 are preferably circular in shape and in one embodiment have a diameter of 0.094". Where the tabs are multi-perforate, the perforations preferably have a centre to centre distance of 0.144" with a perforate area of approximately 40% of the total tab area. Further preferably, the perforations are arranged in rows with every second row offset to provide a close packing perforation density. It will be appreciated, however, that a circular geometry is not essential and that the perforations may be slot, diamond, square, or any other suitable shape.

While the preferred form of the invention utilizes varying tabs which are not perforated being penetrable in situ with a range of suitable fasteners including nails, staples, and/or screws as required, other embodiments utilize various other perforated sheet materials which have sufficient holding strength and rigidity. Tabs of the present invention may be made of any suitable material including metals, plastics, timber or composites such as glass reinforced plastic, etc. Requisite strength and rigidity properties of the tab would depend on the properties of the trim component and the number of tabs proposed per trim component. As indicated previously, the tab may be configured to support and positionally retain the trim member via selection of various features including, for example, any one or more of: material properties, size and shape. Generally, the tabs will require a combination of load bearing strength, bending resistance under cantilevered loads and a resistance to buckling or extension under compressive or tensile loads respectively.

In preferred forms the tabs may include some form of indicia to provide fastener positioning guides and/or other information that may be useful to the installer. The indicia can be formed in any suitable manner including, for example, by embossing, engraving, etching or printing.

Preferably the support structure and corner structure are formed with a weatherproof material such as, for example, weather resistant and/or water resistant house wrap over an OSB substrate.

While three tabs are connected to each window trim member and two tabs to each corner trim member in the accompanying drawings, it will be appreciated that any number of tabs may be used. For example, in the case of short and/or lightweight window trim pieces, a tab affixed at each end of the trim member is likely to be suitable, while for longer and/or heavier trim pieces, it may be necessary to connect one or more tabs along the length of the trim member.

It will be appreciated that concealed tabs in accordance with the present invention are able to be connected to any position on the trim members. This advantageously provides flexibility of positioning the tabs in situ to suit various installation requirements.

Figure 7:
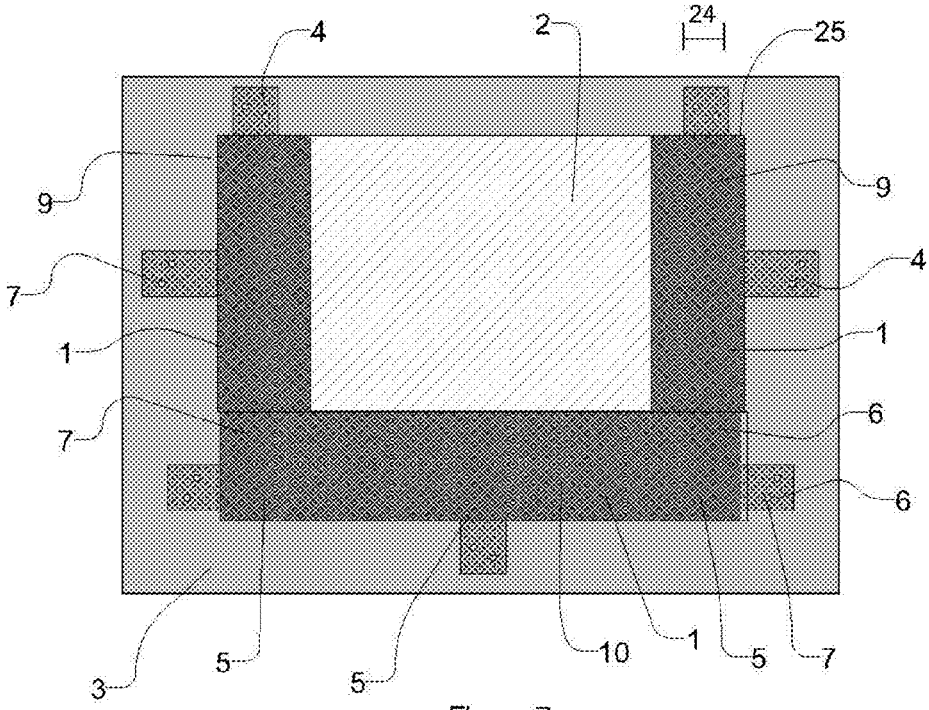
FIG. 7 is a view similar to FIG. 6, showing the bottom trim member as transparent to show the connection between the tabs and the structure facing side of the bottom trim member.

In preferred embodiments, the width 24 of each tab is smaller than the edge dimensions of the trim member or trim member to which it is connected. For example, the width of each tab 4, 16 is significantly smaller than the length of the trim member 1, 14, 15. For installations where a substantially planar tab 4 is used, it is also preferred that the width of the tab 4 is smaller than the width of the trim member 1 to allow for flexibility of connection of tabs to the ends 25 of the trim member. As best shown in FIG. 7, the smaller width of tab 4 allows the second portions of the tab 4 connected to side members 9 to be concealed by the adjacent bottom trim member 10 and top trim member 11 without the tabs overlapping.

In one embodiment, staples are used to connect the load bearing tab 4, 16 to the trim members. These staples are necessarily short enough so that they do not protrude all the way through the trim but have sufficient holding power to maintain the connection between the trim member and the tab under normal load conditions. This is preferably advantageous when the trim member is made of fiber cement. The fasteners used to fix the second portions of the tab 4, 16 to the support structure and corner structure are typically normal nail gun framing constructions nails In another embodiment, hardened "T" nails (Brad nails) are used to connect the load bearing tab 4, 16 to the trim members. These nails are necessarily short enough so that they do not protrude all the way through the trim but have sufficient holding power to maintain the connection between the trim member and the tab under normal load conditions. This is preferably advantageous when the trim member is made of fiber cement. The nails used to fix the second portions of the tab 4, 16 to the support structure and corner structure are typically normal nail gun framing constructions nails.

While nails have been referred to throughout the specification as one method of connecting the tabs to both the trim members and the underlying building structure, it will be appreciated that any suitable means of fastening may be used. This may include, for example, screws, rivets, bolts, staples, adhesives, etc.

Figure 11:
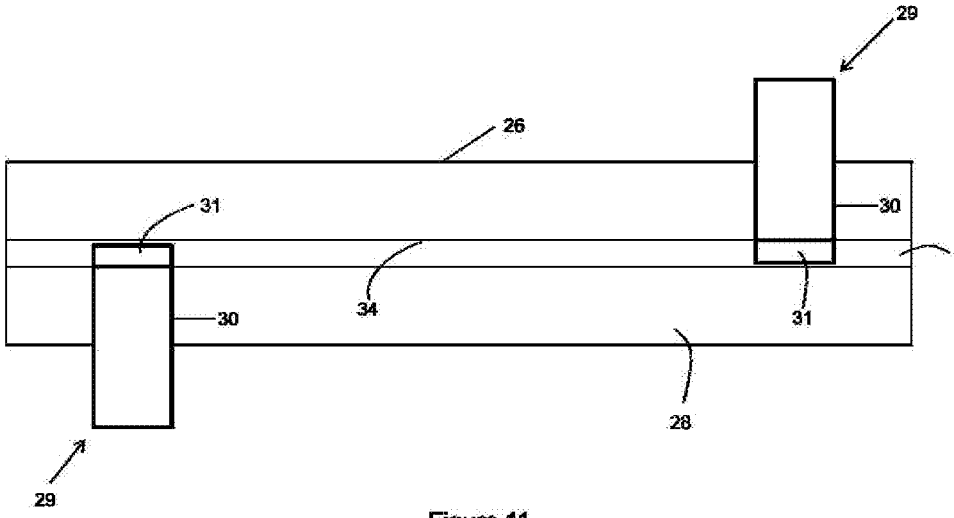
FIG. 11 is an underside plan view of an alternative system incorporating a trim member with a clip retaining groove in its structure facing surface and a second embodiment concealed fixing tab.
Figure 12:
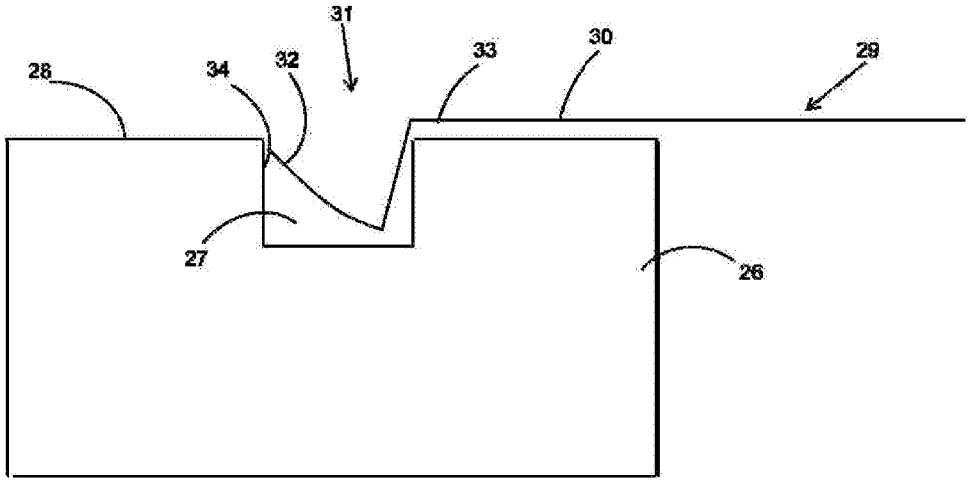
FIG. 12 is a an end view of the trim member and tab assembly shown in FIG. 11.

Referring next to FIGS. 11 and 12, another embodiment of a system for concealed fastening of building finishing elements is illustrated. As shown in FIGS. 11 and 12, the system incorporates a trim member 26 with a clip retaining groove 27 in its structure facing surface 28 and a concealed fixing tab 29. The tab 29 includes on its first portion 30 a retaining formation such as the generally v or tick sectioned clip element shown generally at 31. The clip element is configured in this particular embodiment to have a sprung flange 32 which in use in entering the groove 27, compresses toward the adjacent planar part 33 of the first portion 30, and then springs away to engage against the inner surface 34 of the groove to thereby retain the tab. It will be appreciated that the groove may be a simple channel shape of generally u or v shaped cross section or include some element of undercut such as in an "l" or "t"-slot to help retain the clip portion of the tab. Where the building finishing element is longitudinal such as with the illustrated trim component, the groove is preferably provided along the full length of the building element. In some forms more than one groove may be provided.

While the form of the retaining formation can vary, so can the rest of the tab. For example the second portion may be perforate or solid or any combination thereof. The earlier comments apply in terms of preferred methods of securing the second portion of the tab using one or more siding nails although once again other alternative fasteners may be suitable.

Preferably, the load bearing tabs in all embodiments are formed of aluminum or steel. However, it will be appreciated that the tabs may be formed of any material suitable for supporting the trim members and fixing them to the underlying structure.

The optional perforations in the tabs advantageously allow fastener fixing with thicker tabs than would otherwise be possible. The thickness of the tabs is typically determined by the strength required to support a trim member having a given length and specific orientation, usually horizontal or vertical. The thickness of the tab may also be influenced to some degree by the effect of wind loading on the trim member.

The system advantageously allows the use of standard fastening guns and standard commercially available fasteners. This advantageously results in minimum cost of implementation and minimum additional skills required for installers.

Although preferred embodiments of the invention have been described in detail, it will be appreciated by those skilled in the art that the invention may be embodied in many other forms.

What is claimed is:

1. A load-bearing concealed building finishing element fixing tab comprising:

a tab with a first portion and a second portion, wherein the first portion and the second portion are coplanar, the first portion being connected to a structure-facing surface of a building finishing element such that the second portion extends outwardly from the building finishing element in a direction that is parallel to the plane of the structure-facing surface such that the second portion overhangs a corresponding edge of the building finishing element, the second portion being connected to a support structure thereby to secure a portion of said building finishing element to the support structure whereby the connection between said first portion and the structure-facing surface of the building finishing element is substantially concealed from an outwardly directed exterior-facing surface of the building finishing element.

2. A load-bearing concealed building finishing element fixing tab of claim 1 wherein the tab further includes a perforation for receiving a fastener.

3. A load-bearing concealed building finishing element fixing tab of claim 1 wherein the tab further includes indicia for aligning a fastener.

4. A load-bearing concealed building finishing element fixing tab of claim 1 wherein the width of the tab is less than the width of the structure-facing surface of the building finishing element.

5. A system for concealed fastening of building finishing elements comprising:

a first building finishing element having a structure-facing surface and an exterior-facing surface;

a second building finishing element; and at least one load-bearing concealed building finishing element fixing tab, the tab including:

a first portion and a second portion, the first portion being connected to the structure-facing surface of the building finishing element such that the second portion extends outwardly past a corresponding edge of the building finishing element, the second portion being connected to a support structure thereby to secure a portion of said building finishing element to the support structure whereby the connection between said first portion and the structure-facing surface of the building finishing element is substantially concealed from the outwardly directed exterior-facing surface of the building finishing element, wherein the second building finishing element is disposed on top of the second portion of the fixing tab in a manner such that the second portion is concealed by the second building finishing element.

6. A system for concealed fastening of building finishing elements of claim 5 wherein the tab further includes a perforation for receiving a fastener.

7. A system for concealed fastening of building finishing elements of claim 5 wherein the tab further includes indicia for aligning a fastener.

8. A system for concealed fastening of building finishing elements of claim 5 wherein the width of the tab is less than the width of the structure-facing surface of the building finishing element.

9. A system for concealed fastening of building finishing elements of claim 5 wherein the structure-facing surface of the building finishing element is recessed for locating the first portion of the tab for the tab to be generally flush with the structure-facing surface of the trim member.

10. A system for concealed fastening of building finishing elements of claim 5 wherein the structure-facing surface of the building finishing element is recessed for locating the first portion to enable the tab to be generally flush with the structure-facing surface of the trim member.

11. A method of securing a plurality of building finishing elements to a support structure, said method comprising the steps of:

selecting one or more load bearing concealed building finishing element fixing tabs, each tab including a first portion and a second portion, connecting said first portion of the tab to a structure-facing surface of a first building finishing element such that the second portion extends outwardly and overhangs from a corresponding edge of the first building finishing element, securing the second portion of the tab to a support structure thereby retaining a portion of said first building finishing element to the support structure whereby the connection between said first portion and the structure-facing surface of the first building finishing element is substantially concealed from the outwardly directed exterior-facing surface of the first building finishing element, and securing a second building finishing element to the support structure in a manner such that the second building finishing element conceals from view the second portion of the tab.

12. A method of securing a building finishing element to a support structure of claim 11 wherein the tab further includes a perforation for receiving a fastener.

13. A method of securing a building finishing element to a support structure of claim 11 wherein the tab further includes indicia for aligning a fastener.

14. A method of securing a building finishing element to a support structure of claim 11 wherein the width of the tab is less than the width of the structure-facing surface of the building finishing element.

15. A method of securing a building finishing element to a support structure of claim 11 wherein the structure-facing surface of the building finishing element is recessed for locating the first portion to enable the tab to be generally flush with the structure-facing surface of the building finishing element.

16. A method of securing a building finishing element to a support structure of claim 11 wherein the structure-facing surface of the building finishing element is recessed for locating the first portion of the tab for the tab to be generally flush with the structure facing surface of the building finishing element.

* * * * *